US006382236B1

(12) United States Patent
Kuhlman

(10) Patent No.: US 6,382,236 B1
(45) Date of Patent: May 7, 2002

(54) LABORATORY FAUCET AND METHOD OF PRODUCTION

(75) Inventor: Charles E. Kuhlman, Chattanooga, TN (US)

(73) Assignee: Collegedale Casework LLC, Collegedale, TN (US)

( * ) Notice: Subject to any disclaimer, the term of this patent is extended or adjusted under 35 U.S.C. 154(b) by 0 days.

(21) Appl. No.: 09/590,986

(22) Filed: Jun. 9, 2000

(51) Int. Cl.[7] ..... E03C 1/10
(52) U.S. Cl. ..... 137/218; 4/676; 137/801
(58) Field of Search ..... 4/676, 678; 137/217, 137/218, 801

(56) References Cited

U.S. PATENT DOCUMENTS

| | | | | | |
|---|---|---|---|---|---|
| 3,424,188 | A | * | 1/1969 | Whitaker et al. | 137/218 |
| D239,625 | S | * | 4/1976 | Carlson | |
| D368,132 | S | | 3/1996 | Errington | D23/241 |
| 6,123,095 | A | * | 9/2000 | Kersten et al. | 137/218 |

FOREIGN PATENT DOCUMENTS

| | | | | |
|---|---|---|---|---|
| DE | 1076047 | * | 2/1960 | 4/678 |

OTHER PUBLICATIONS

The Chicago Faucet Company, Product Bulletin No. 505, dated Mar. 13, 1996, 4 pages.

Sheldon Laboratory Systems, Axis 3 Brochure, date unknown, pp. 1–3.

Sheldon Laboratory Systems, Vandalgard Unicast Laboratory Fixture, 1977, pp. 1, 2.

Fittings and Fixtures, Water Faucets, 1997, p. 5.

* cited by examiner

*Primary Examiner*—Gerald A. Michalsky
(74) *Attorney, Agent, or Firm*—Stephen J. Stark; Miller & Martin LLP

(57) ABSTRACT

A laboratory faucet has a base, a spout and a vacuum breaker wherein at least a portion of the vacuum breaker is cast within an upper portion of the spout. The upper portion of the spout assists in protecting the vacuum breaker from vandalistic acts. Additionally, the base of the faucet is advantageously designed to provide access to the valve operators to allow use of the valve operators at a location to minimize drippage from the operator's hands onto a counter top. Furthermore, the base may be configured with a gas supply controlled by valves.

16 Claims, 1 Drawing Sheet

LABORATORY FAUCET AND METHOD OF PRODUCTION

BACKGROUND OF THE INVENTION

1. Field of the Invention

The present invention relates generally to devices which are utilized to provide liquid and/or gaseous fluids and, more particularly, to faucets having a liquid outlet and a gas outlet and a method of producing the same.

2. Description of Related Art

Laboratory faucets are necessary in many environments including industrial, government, health care, and education where scientific/technical work is being performed. Many public and private schools in this country have some type of science laboratory facility. Some laboratory facilities utilized in these schools include laboratory sinks and faucets. Some faucets provide the capability of supplying water from a single source such as a hot or cold water source. Other faucets provide the ability to mix cold and hot water to allow a user to provide water at a variety of ranges of temperatures. Some faucets also include a vacuum breaker connected at some location to the spout. Additionally, some prior art faucets include a base unit which may also supply a vacuum, or various pressurized gasses for various kinds of burners, equipment, or other uses.

Vacuum breakers in faucets may be utilized to prevent fluid from entering through the outlet nozzle of the faucet and proceeding through the spout to the water inlet to potentially contaminate the water supply. A lower pressure at the inlet than at the outlet may produce this situation. Vacuum breakers often utilize a piston which moves to prevent back flow between the inlet and the outlet should a low pressure situation arise at the inlet. As the piston seals off the inlet from the outlet, the outlet is then opened to the environment through an air passageway. The piston action assists in preventing contamination of the water supply.

A need exists to provide a method of manufacturing laboratory faucets wherein at least a portion of the vacuum breaker is integrally formed within a portion of the spout of the water supply of the faucet.

Additionally, the protecting cap on prior art vacuum breaker designs typically extends outwardly of the piping supplying the water to the outlet of the nozzle. A need exists to protect this cap from vandalism such as by striking with a blunt object such as a hammer, chair leg, etc.

Furthermore, the base designs of the prior art laboratory faucets could be improved by orienting at least a portion of the operators above the sink.

SUMMARY OF THE INVENTION

The present invention recognizes and addresses the foregoing disadvantages, and others, of prior art construction and methods. Accordingly, it is an object of the present invention to provide a laboratory faucet and a method of constructing a laboratory faucet which provides a faucet having a protected vacuum breaker which is more vandal resistant.

An additional object of the present invention is to provide a method of forming a faucet wherein a portion of the spout is constructed to include a portion of the vacuum breaker therein.

Another object of the present invention is to provide operators which may be located at least partially above a sink.

A laboratory faucet constructed in accordance with the present invention comprises a mixing faucet with a hot and cold inlet in a single outlet for water flow. As water enters the spout proceeding toward the nozzle, water passes through a vacuum breaker. The vacuum breaker is preferably formed to at least some extent within the spout casting. Other machining steps may be necessary to complete construction of the vacuum breaker at least partially within the spout. Additionally, the cap of the vacuum breaker is preferably less than or equal to a width of the top portion of the spout. This feature assists in protecting the vacuum breaker cap from vandalism.

The base of the laboratory faucet preferably includes angled planes housing the water valves. The angled planes assist in locating at least a portion of the valve operators above a sink in a preferred embodiment. Angled portions of a rear section of the base contain gas valves which are supplied by a gas inlet through a bottom portion of the base. The angular relationship of the gas valve operators relative to the water valve operators has been found to minimize interference between the two.

Reference will now be made in detail to the presently preferred embodiment of the invention, one or more examples of which are illustrated in the accompanying drawings. Each of these examples provides an explanation of the invention, not a limitation of the invention. In fact, it will be apparent to those schooled in the art that modifications and variations can be made to the present invention without departing from the scope of the invention.

DETAILED DESCRIPTION OF THE PREFERRED EMBODIMENTS

Figure 1:
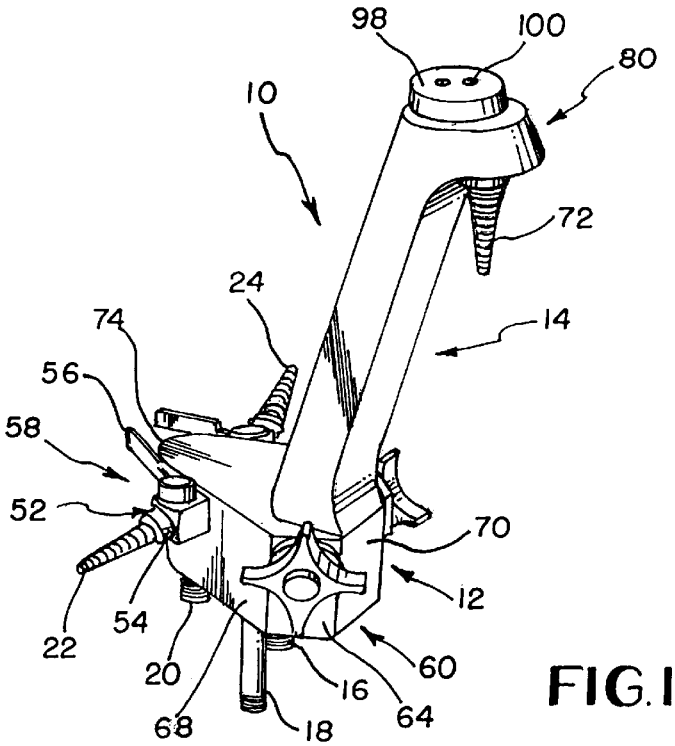
FIG. 1 is a perspective view of a preferred embodiment as viewed at an angle from the side.
Figure 2:
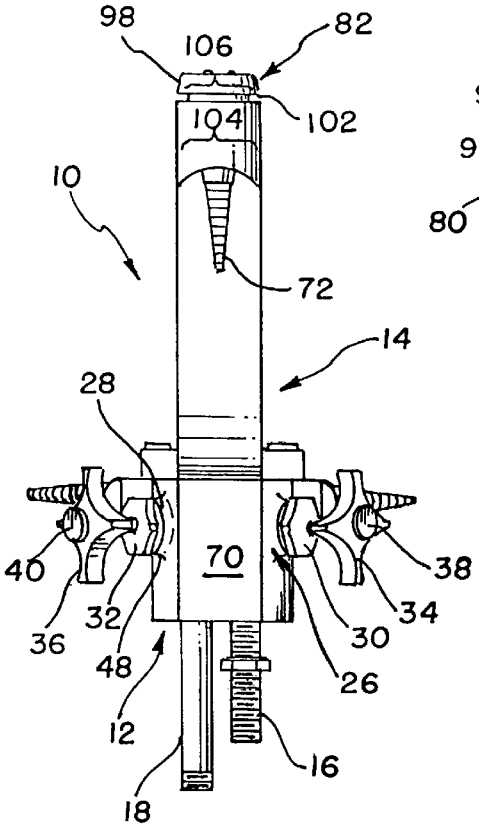
FIG. 2 is a plan view of the preferred embodiment of the present invention as viewed from the front.
Figure 3:
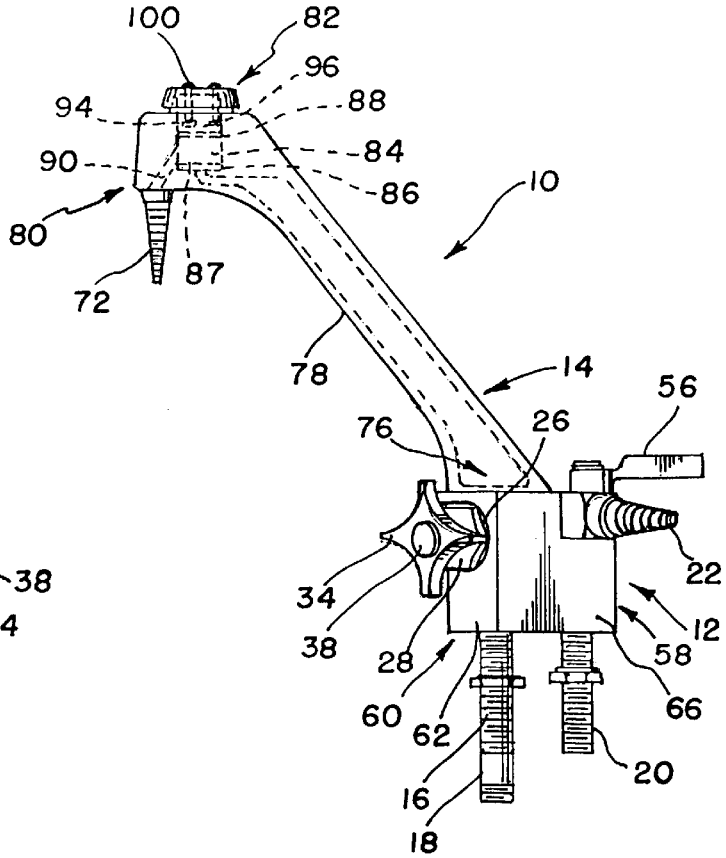
FIG. 3 is a plan view of the present invention as viewed from the side with internal workings illustrated in phantom.

FIGS. 1–3 illustrate a preferred embodiment of a laboratory faucet 10. The faucet 10 is preferably comprised of a base 12 connected to a spout 14. The base 12 is preferably located atop a counter wherein connections, illustrated as cold water inlet 16, hot water inlet 18, and gas inlet 20 may proceed therethrough. The connections are preferably connected to their respective supplies, namely, the cold water inlet 16 is connected to a cold water source, the hot water inlet is preferably connected to a hot water source and the gas inlet 20 is preferably connected to a source of gas, such as propane, acetylene, natural gas, or any other gas source utilized in a laboratory environment. Furthermore an air source, a vacuum source, or another appropriate source may be connected to the gas inlet 20. As the fluids enter the base 12 through the connections, the various fluids are directed to outlets in the base whether it be through the nozzle 72 connected to the spout 14 for liquid or through gas outlets 22, 24. The connections also preferably assist in the mounting of the base 12 to a counter or other support. The connections may connect to a lower portion of the base 12 or may extend into a cavity within the base 12.

Preferably, the base 12 includes extensions 26, 28. The extensions 26, 28 assist in housing valves for controlling the flow of water through the faucet 10. A mixing faucet is illustrated as the preferred embodiment. A single water faucet, namely a water faucet that dispenses water from a single source which typically has only one valve for supplying water from the source also is another embodiment. In that embodiment, only one extensions 26, 28 may be present along with a valve, at least partially disposed therein. The other extensions 26, 28 may be machined off for a smooth surface, left as an extrusion, or otherwise omitted.

The extensions 26, 28 house, at least partially, a valve therein. A cap such as caps 28, 30 may be utilized to assist in holding the valve in place. The caps 28, 20 are preferably packing nuts which may be additionally secured with a set screw. Valve operators 34, 36 are utilized to operate the valves to control the flow of the water from the faucet 10. The handles 34, 36 illustrated are forged brass four arm handles. End caps 38, 40 may be utilized to identify water source such as hot or cold and/or may be utilized to protect a connection mechanism such as a screw which may be utilized to hold the handle 34, 36 to valve stems. The end caps 38, 40 illustrated are colored plastic index discs secured with an adhesive. Although handles 34, 36 are illustrated as water controls, other operators including wing blades or other operators could be utilized.

The extensions 26, 28 are preferably substantially cylindrical wherein portions of the extensions 26, 28 have an exterior surface which is substantially circular. The extensions 26, 28 preferably connect with the base 12 through a smooth transitional curve 48. The extrusions 26, 28 are preferably integral to the base 12.

In the preferred embodiment, the base 12, including extensions 26, 28, is forged from a brass material. Of course, other methods known in the art may also be utilized to manufacture the base 12 according to the presently preferred embodiment.

The base 12 additionally houses at least a portion of the gas supply, if utilized. As shown in FIG. 1, the gas supply consists of a gas inlet 20 which directs gaseous fluid to gas outlet 22. The gas inlet 20 and gas outlet 22 are connected through the base 12. In order to connect the gas outlet 22 to the base 12, preferably the base 12 is drilled and fitted with a gas valve 52. The gas valve 52 preferably is comprised of a gas valve body 54 housing the valve mechanism such as a ball valve or other valve. The gas valve operator 56 is illustrated as a handle. Typically, valves of this nature are often in the closed position as illustrated in FIG. 1 when the valve operator 56 is substantially perpendicular to the central axis of the valve body 54. When the gas valve operator 56 is substantially located along the axis of the valve body 54, the valve is open. Connected to the outlet of the gas valve 52 is gas outlet 22. In the preferred embodiment, a nonremovable ten serration hose end is utilized. This outlet-type may be utilized with a flexible hosing to transport the gas to a secondary use device. Of course, other gas outlets 22 styles may also be utilized.

The gas outlets 22 are preferably located near a back portion 58 of the base 12. This location has been found to provide minimal interference with a sink and/or the water controls and provide minimum extension to rear of the base 12. The water controls, illustrated as handles 34, 36 are preferably located near a front portion 60 of the base 12. This location has been found preferable as they are relatively proximate to the sink where the water would be directed to and/or above.

The base 12 preferably has a front face 70 which faces the nozzle 72, also referred to as the water outlet. The front face 70 is preferably substantially planar. Disposed adjacent to the front face 70 are first faces 62, 64. The first faces 62, 64 preferably angled relative to the front face 70. Located on the first faces 62, 64 are the extensions 26, 28. The locating of the extension 26, 28 on the first faces 62, 64 has been found to provide easy access to the water controls.

The first faces 62, 64 preferably angle between 10 and 70 degrees relative to a plane including a front face 70. It is more preferable that the first faces 62, 64 be angled between 20 and 60 degrees relative to the plane including the front face. It is also preferred that the first faces 62, 64 are angled at approximately 30 degrees relative to the plane including the front face 70.

The angular relationship of the first faces 62, 64 relative to the front face has been found to assist in locating valve operators, such as handles 34, 36 closer, if not above a sink. The locating of the handles in this manner allows a user with wet hands to drip over the sink instead of over a counter area. The extrusions 26, 28 coupled with the valve stems 42, 44 assist in locating at least a portion of the operators in an open or shut position forward of the plane incorporating the front portion 70. Therefore, a portion of the operator may be located above the sink.

The base 12 also includes two sides faces 66, 68. The side faces 66, 68 preferably meet at a back 74. The back 74 is preferably a curved segment which joins the side faces 66, 68 together. The planes incorporating the side faces 66, 68 preferably meet at an angle between 10 and 80 degrees, and more preferably between 20 and 70 degrees. It is also preferred that the angle between the planes including the side faces meet between 30 and 60 degrees, and most preferably at about 50 degrees. The angular relationship of the side faces 66, 68 allows for the gas outlets 22, 24 to be disposed at a back portion 58 of the base 12 while still allowing access to the gas valve operators 56 from a side of the base 12. Furthermore, the angular relationship reduces the likelihood that any of the operators such as handles 34, 36 or the gas valve operators 56 interfere with one another during operation.

The base 12 is connected to the spout 14 at connection 76. Preferably the spout 14 is bolted or otherwise connected to the base 12 from within the base 12. The spout 14 may be manufactured from a brass material by casting, however, other materials and procedures could also be utilized. The spout 14 has a bottom portion 76 which connects to the base 12. The spout 14 extends up along a neck 78 toward an upper, or top portion 80. The top portion 80 houses at least a portion of a vacuum breaker 82 therein.

In the prior art, vacuum breakers are separate components which were connected to piping typically by joining with piping. In the faucet according to the present invention, at least a portion of the vacuum breaker 82 is formed integral to the spout 14. As can be seen in phantom in FIG. 3, the vacuum breaker 82 is comprised of a cavity 84 and a piston 87. As water enters through the neck 78 of the spout 14 pressure at the bottom portion of the piston 87 forces the piston upwards to the upper position 88. When the piston 87 is in the upper position 88, water may flow into a portion of a cavity 84 and out passageway 90 and through nozzle 72.

If a low pressure situation should develop in the neck, base, water inlet, or water source as compared to the nozzle 72, the piston 87 moves from the upper position 88 to the lower position 86. A first set of stops 92 which is preferably circular and forms a seal with the piston 87 allows the piston 87 to move to the lower position 86 when a relatively lower pressure situation develops within the neck 78. When the piston 87 is in the lower position 86, the vacuum is broken relative to the nozzle 72 such that no siphoning, or back flow action, occurs since air passageway 96 will be in communication with nozzle 72. Water is not transmitted from the nozzle 72 to the water supply to potentially contaminate the water supply. Once the water pressure is greater in the neck 78 than in the cavity 84 above the piston 87, the piston 87 moves from the lower position 86 to the upper position 88 and water may flow out the nozzle 72 through cavity 84 and passageway 90. Other water outlets other than nozzle 72 may also be utilized.

A second set of stops 84 is preferably present in an annular fashion above the upper position 88 to assist in retaining the piston 87 in a normal operating position. Above the cavity 84 is located air passageway 96. The air passageway 96 communicates with ambient air to assist in breaking the vacuum when the piston 87 is in the lower position 86. Vacuum breaker cap 98 assists in preventing debris or other matter from entering the air passageway 96. The vacuum breaker cap 98 is held in place preferably by a vandal resistant restraining device such as vandal resistant screws 100 illustrated. Vandal resistant screws 100 have a relatively low profile and require a special screw driver to operate. Of course, other fasteners and/or connectors may hold the cap 98 to the vacuum breaker 82 and/or the top portion 80.

The particular nozzle 72 utilized in the preferred embodiment is a ten serration hose end which receives a flexible tubing. These serrations assist in maintaining the tubing in place to prevent leak by at the faucet 10. It is preferred that the nozzle 72 is non-removable relative to the spout 14 to deter potential tampering with the faucet 10. Other spouts or outlets may also be used instead of or in addition to nozzle 72.

The spout 14 is preferably formed by casting whereby a portion of the cavity 84 is formed during the casting process. Additionally, much of the interior portion of the neck 78 is also formed during the casting process as well. Machining steps may be performed to locate a point of communication between the lower portion 76 of the spout 14 with the water connection proceeding from the water inlet(s) 16, 18, if used, through the base 12 and valves controlled by valve operators 34, 36.

The preferred method of casting a spout 14 comprises shaping a spout mold to have a shape to provide a cavity within a top portion 80 of the spout 14. The cavity 84 in the spout 14 forms a portion of a vacuum breaker 82. Next a substance, such as brass, is obtained in a pourable condition. The substance is then poured into the spout mold and allowed to harden to a solid form. Next, the solid spout 14 is removed from the mold. Further machining steps may then be performed. For example, the upper portion 82 of the spout 14 may be machined to accept connectors such as vandal resistant screws 100 for a vacuum breaker cap 98 to be installed. Additionally, a piston 87 may be placed within the vacuum breaker 82 and the vacuum breaker cap 98 may be appropriately placed.

Additional machining or other processes may be necessary in the preferred embodiment to complete construction of the cavity 84, passageway 90, and air passageway 96, or other portion of the vacuum breaker 82, as well as to connect the nozzle 72 in the top portion 80 of the spout 14.

During the casting process, the top portion 80 of the spout 14 is preferably constructed to have a first width 104 greater than or equal to a second width 106 of the vacuum breaker cap 98. By having the first width 104 of the top portion 80 greater than or equal to the second width 106 of the vacuum breaker cap 98, a potential vandal is afforded with a relatively small opportunity to vandalize the vacuum breaker 82. Namely, it will be very difficult to utilize a blunt object to strike the lower lip portion 102 of the cap in an attempt to destroy that portion of the faucet 10. Although many faucets 10 may be located in places where vandal resistivity is not a concern, unfortunately some faucets 10 may be located in vandal suspect locations. The top portion 80 of the spout 14 may be tapped for receiving the screws 100.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A faucet comprising:

a base;

a spout having an upper and lower portion, the lower portion connected to the base, the upper portion having a cavity and a first and second passageway therein, said cavity connected to the first and second passageway;

a water outlet connected to said first passageway in the upper portion of the spout;

a water inlet in fluid communication with the spout and water outlet through the base;

a vacuum breaker having a portion including the cavity in the upper portion of the spout; and a protective cap located on a top portion of the upper portion, said protective cap having a downwardly projecting lip, said lip having a lower lip portion with a width shorter than a smallest width of a section of the upper portion of the spout.

2. The faucet of claim 1 wherein the water inlet is a cold water inlet, and further comprising a hot water inlet in fluid communication with the water outlet.

3. The faucet of claim 1 further comprising:

a gas outlet connected to said base;

a gas valve in communication with said gas outlet capable of selectively controlling the flow of a gas through the gas outlet; and a gas inlet in fluid communication with said gas valve.

4. The faucet of claim 3 wherein the gas outlet and gas valve are connected to a back portion of said base.

5. The faucet of claim 4 wherein the base further comprises a side face and the gas outlet is located on a side face.

6. The faucet of claim 5 wherein the base further comprises a front face and a first face, the front face located at a front portion of the base, and the first face adjacent to said front face, the first face angled relative to said front face.

7. The faucet of claim 6 wherein the base further comprises an extension located on said first face, said extension assisting in supporting a water valve within the base.

8. A laboratory faucet comprising:

a base having a front portion, a back portion, a front face and a first face, said front face on the front portion, said first face adjacent and angled relative to said front face;

a spout having an upper and lower portion, the lower portion connected to the base, the upper portion having a cavity and a first and second passageway therein, said cavity connected to the first and second passageway, the upper portion of the spout having a first minimum width, the cavity in the upper portion forming a portion of a vacuum breaker, said vacuum breaker having a vacuum breaker cap having a downwardly projecting lip having a lower lip with a second width, wherein the first width is greater than the second width;

a water outlet connected to said first passageway in the upper portion of the spout;

a water inlet in fluid communication with the spout and water outlet through the base; and a water valve in communication with the water inlet and the water outlet, said water valve controlled by an operator, said operator supported by said first face of said base, at least a portion of said operator extending forward of said front face.

9. The laboratory faucet of claim 8 wherein a first angle between the front face and the first face is between about 10 and 70 degrees.

10. The laboratory faucet of claim 9 wherein the first angle is about 30 degrees.

11. The laboratory faucet of claim 9 further comprising a first side face adjacent and angled at a second angle relative to said first face.

12. The laboratory faucet of claim 11 wherein the second angle between the first side face and first face is between about 90 and 160 degrees.

13. The laboratory faucet of claim 11 wherein the second angle is about 125 degrees.

14. The laboratory faucet of claim 13 further comprising a second side face connected to the first side face at the back portion wherein an angle is formed between the first and second side faces at about 50 degrees.

15. The laboratory faucet of claim 8 further comprising an extension connected to said first face, at least a portion of said extension housing a portion of said water valve.

16. The laboratory faucet of claim 15 wherein an outer portion of said extension is substantially circular.

* * * * *